US010458423B2

(12) United States Patent
Murakami et al.

(10) Patent No.: US 10,458,423 B2
(45) Date of Patent: Oct. 29, 2019

(54) IMPELLER AND FAN INCLUDING THE IMPELLER

(71) Applicant: MINEBEA MITSUMI INC., Kitasaku-Gun, Nagano (JP)

(72) Inventors: Naoya Murakami, Fukuroi (JP); Yukihiro Higuchi, Fukuroi (JP); Haruomi Morohashi, Hamamatsu (JP); Toshiaki Seima, Fukuroi (JP); Koichi Tamai, Kakegawa (JP)

(73) Assignee: Minebea Mitsumi Inc., Nagano (JP)

( * ) Notice: Subject to any disclaimer, the term of this patent is extended or adjusted under 35 U.S.C. 154(b) by 220 days.

(21) Appl. No.: 15/613,330

(22) Filed: Jun. 5, 2017

(65) Prior Publication Data

US 2017/0350409 A1 Dec. 7, 2017

(30) Foreign Application Priority Data

Jun. 6, 2016 (JP) ..... 2016-112333

(51) Int. Cl.

| | |
|---|---|
| ***F04D 17/14*** | (2006.01) |
| ***F04D 29/22*** | (2006.01) |
| ***F04D 17/16*** | (2006.01) |
| ***F04D 25/10*** | (2006.01) |
| ***F04D 25/06*** | (2006.01) |
| ***F04D 29/38*** | (2006.01) |
| *F24F 7/06* | (2006.01) |

(52) U.S. Cl.

CPC ..... *F04D 29/2216* (2013.01); *F04D 17/14* (2013.01); *F04D 17/165* (2013.01); *F04D 25/0613* (2013.01); *F04D 25/10* (2013.01); *F04D 29/384* (2013.01); *F24F 7/06* (2013.01)

(58) Field of Classification Search

CPC .... F04D 29/2216; F04D 17/14; F04D 17/165; F04D 25/10; F04D 29/384; F24F 7/06

See application file for complete search history.

(56) References Cited

U.S. PATENT DOCUMENTS

| | | | | |
|---|---|---|---|---|
| 4,358,245 | A | 11/1982 | Gray | |
| 2004/0253103 | A1* | 12/2004 | Iwase | F04D 29/384 415/220 |
| 2008/0019826 | A1 | 1/2008 | Arinaga et al. | |
| 2011/0262271 | A1 | 10/2011 | Fukuda et al. | |
| 2013/0209242 | A1* | 8/2013 | Ota | F04D 29/164 415/185 |

FOREIGN PATENT DOCUMENTS

| | | | |
|---|---|---|---|
| JP | S57-83695 | A | 5/1982 |
| JP | 2004-332674 | A | 11/2004 |
| JP | 2006-037800 | A | 2/2006 |
| JP | 2011-247246 | A | 12/2011 |

* cited by examiner

*Primary Examiner* — Kevin A Lathers

(74) *Attorney, Agent, or Firm* — Carrier Blackman & Associates, P.C.; Joseph P. Carrier; Jeffrey T. Gedeon

(57) ABSTRACT

An impeller of this disclosure includes a hub having a ring shape; and a plurality of blades that are provided on an outer periphery of the hub, wherein the blade has a trailing edge formed such that an inner side of a radial width of the blade is curved in a direction opposite to a rotation direction, in a plan view as viewed in a direction of a rotation axis.

11 Claims, 10 Drawing Sheets

FIG.8A - COMPARATIVE EXAMPLE -
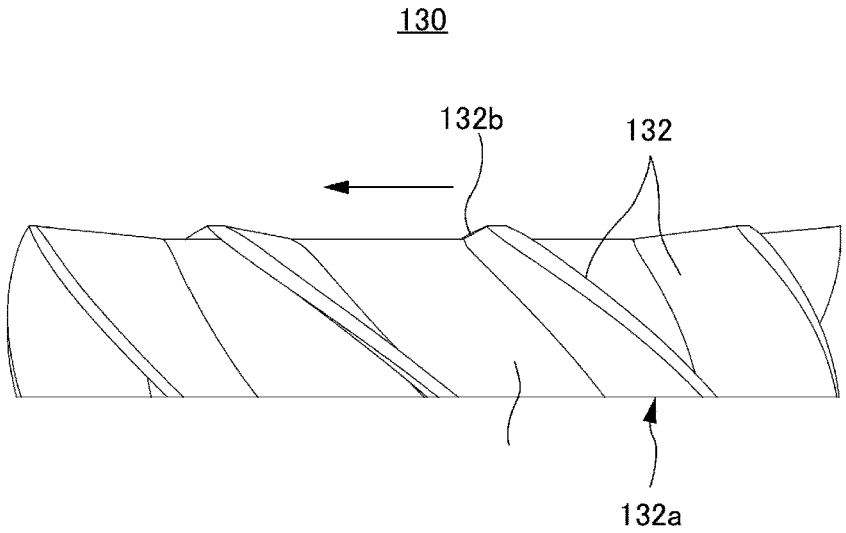
FIG.8B - COMPARATIVE EXAMPLE -
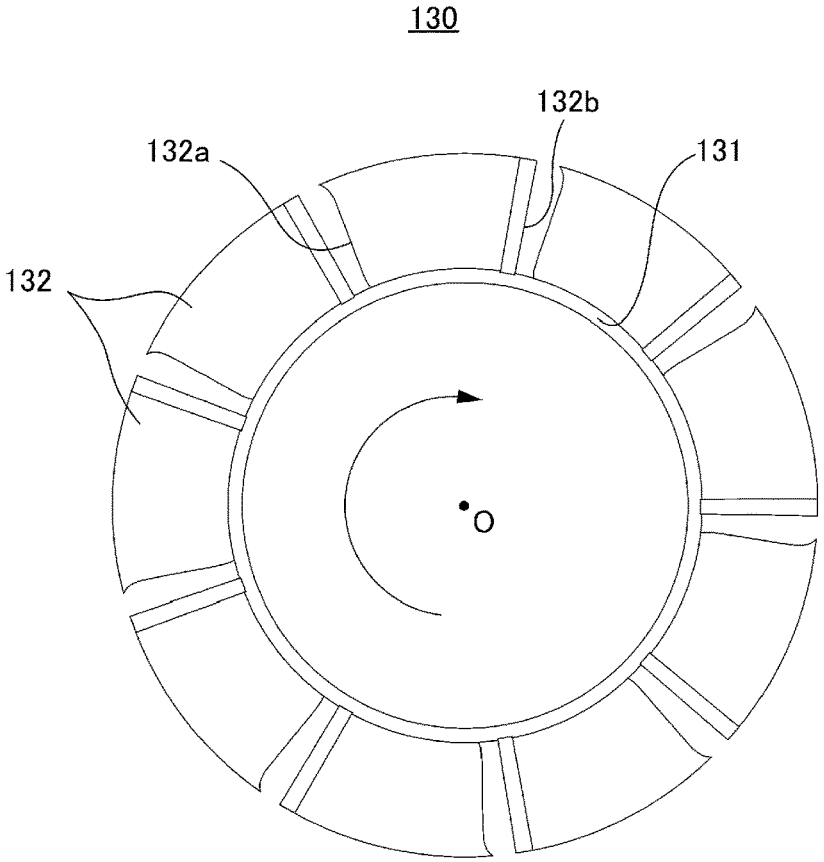

IMPELLER AND FAN INCLUDING THE IMPELLER

CROSS-REFERENCE TO RELATED APPLICATION

This application claims priority from Japanese Patent Application No. 2016-112333 filed on Jun. 6, 2016, the entire subject matter of which is incorporated herein by reference.

TECHNICAL FIELD

This disclosure relates to an impeller and a fan including the impeller.

BACKGROUND

There is an axial fan that includes an impeller having a hub and a plurality of blades disposed on an outer periphery of the hub, and a housing surrounding the impeller. The blade has a leading edge angle ($\alpha$) which is within a range of −8 degrees to −20 degrees, an attaching angle ($\beta$) which is within a range of 36 degrees to 50 degrees, and a twisting angle ($\theta$) which is within a range of 10 degrees ±2 degrees (see JP-A-2011-247246).

SUMMARY

It is desirable for fans to obtain high cooling performance by improving air volume-static pressure characteristic without increasing power consumption.

This disclosure is to provide an impeller capable of improving air volume-static pressure characteristic while suppressing an increase in power consumption and a fan including the impeller.

This disclosure provides an impeller includes: a hub having a ring shape; and a plurality of blades that are provided on an outer periphery of the hub, wherein the blade has a trailing edge formed such that an inner side of a radial width of the blade is curved in a direction opposite to a rotation direction, in a plan view as viewed in a direction of a rotation axis.

In the above described impeller, the blade may have a shape, of which the trailing edge swells toward a suction side.

In the above described impeller, the blade may be formed such that a chord length at an outermost side in a radial direction is longer that a chord length at a side closest to a rotation center.

In the above described impeller, in a plan view as viewed in the direction of the rotation axis, the blade may have a leading edge that is curved in the rotation direction.

In the above described impeller, in the plan view as viewed in the direction of the rotation axis, the leading edge may be formed such that an outer end of the leading edge is located closer to a side in the rotation direction than a straight line connecting the rotation center and a hub-side end of the leading edge.

In the above described impeller, in a view as viewed in a direction perpendicular to the rotation axis, the leading edge may be formed such that the outer end of the leading edge comes outward out of an end, which is the outer peripheral surface of the hub, on the leading edge.

In the above described impeller, the blade may be formed such that the outer end of the leading edge is curved toward the pressure side.

In the above described impeller, the blade may be formed such that a maximum camber at the outermost side in the radial direction of the blade and a maximum camber at a side closest to the rotation center are larger than a maximum camber at an approximate center of the radial width.

In the above described impeller, the maximum camber at the outermost side in the radial direction and the maximum camber at the side closest to the rotation center may be larger than 0.2% of a chord length, and the maximum camber at the approximate center of the radial width may be less than 0.2% of the chord length.

In the above described impeller, in the plan view as viewed in the direction of the rotation axis, two blades adjacent to each other may be formed such that a part of the leading edge of one blade overlaps with a part of the trailing edge of the other blade.

In the above described impeller, the trailing edge may be located on a plane substantially flush with the end of the hub on the trailing edge.

A fan may include the above-described impeller; and a motor configured to rotate the impeller.

The above-described fan may includes a casing, wherein the casing includes: a base portion on which the motor is disposed; a sidewall portion that is provided along the outer periphery of the blade and covers the outer periphery of the leading edge of the blade; and a connection portion that connects the sidewall portion and the base portion.

According to this disclosure, it is possible to provide an impeller capable of improving the air volume-static pressure characteristic while suppressing the increase in power consumption and the fan including the impeller.

BRIEF DESCRIPTION OF THE DRAWINGS

The foregoing and additional features and characteristics of this disclosure will become more apparent from the following detailed descriptions considered with the reference to the accompanying drawings, wherein:

FIGS. 8A and 8B are views illustrating the impeller according to the comparative example, wherein FIG. 8A is a plan view of an outer peripheral surface of a hub as viewed from the front; FIG. 8B is a plan view of the air inlet of the impeller as viewed in a direction of a rotation axis;

FIGS. 9A and 9B are graphs indicating a camber of the blade according to the embodiment of this disclosure and a camber of a blade according to the comparative example, wherein FIG. 9A is the graph indicating the camber of the blade according to the comparative example; and FIG. 9B is the graph indicating the camber of the blade according to the embodiment of this disclosure.

DETAILED DESCRIPTION

Figure 1:
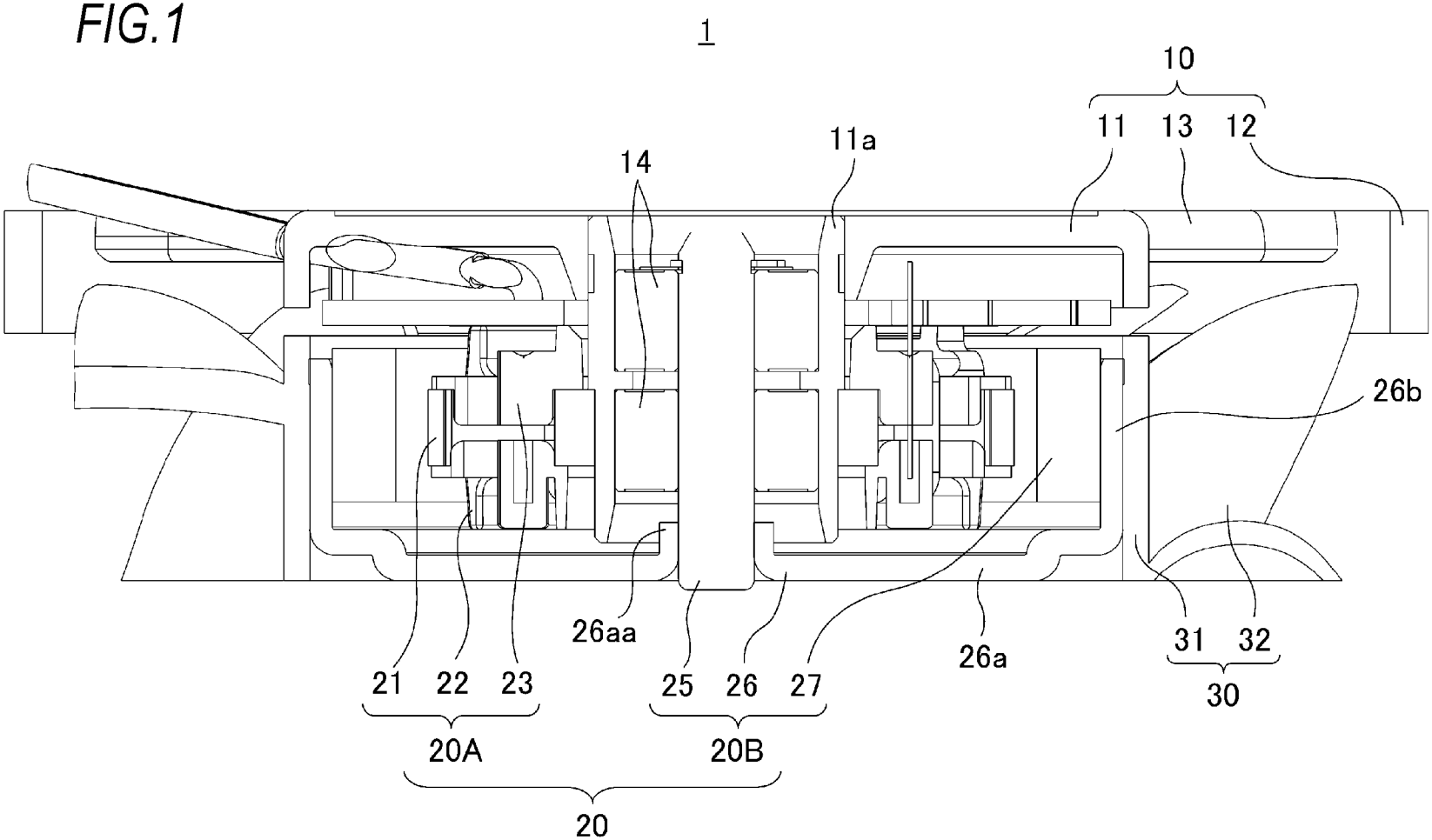
FIG. 1 is a cross-sectional view of a fan according to an embodiment of this disclosure.

A aspect for carrying out (hereinafter, referred to as an "embodiment") of this disclosure will be described in detail below with reference to the accompanying drawing The same elements are denoted by the same reference numerals throughout the description of the embodiment.

Figure 2:
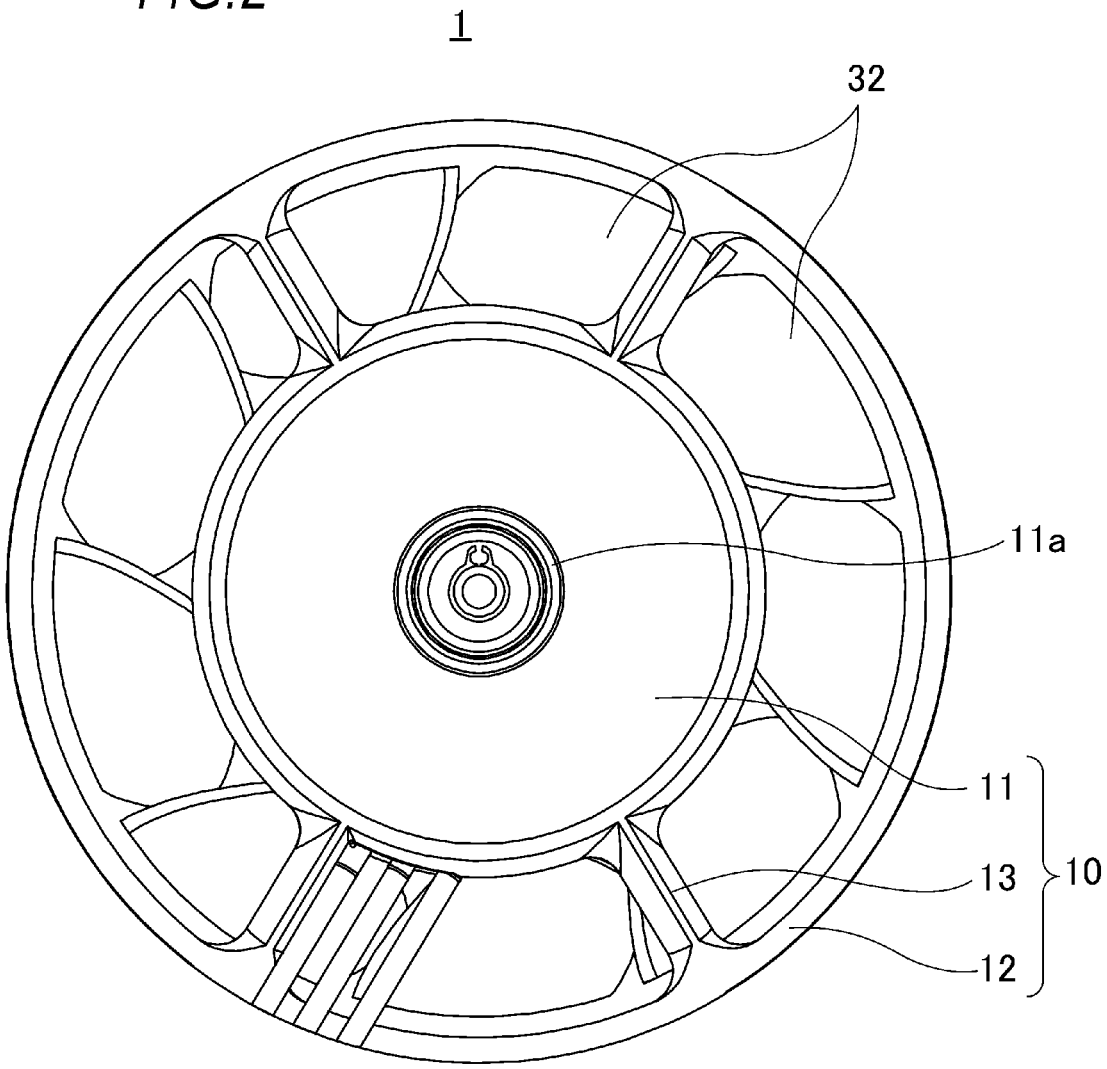
FIG. 2 is a plan view of the fan according to the embodiment of this disclosure as viewed from an air inlet.

FIG. 1 is a cross-sectional view of a fan 1 according to an embodiment of this disclosure, and FIG. 2 is a plan view of the fan 1 as viewed from an air inlet.

In FIG. 1, an upper side is an air inlet, a lower side is an air outlet, and thus the air flows from the upper side to the lower side in FIG. 1 by the fan 1.

As illustrated in FIG. 1, the fan 1 includes a casing 10 made of resin, a motor 20 attached to the casing 10, and an impeller 30 attached to the motor 20.

However, the casing 10 may be unnecessary in some cases depending on a using mode of the fan, so that the casing 10 may be omitted in these cases.

In addition, the casing 10 may be made of metal without being limited to the resin. However, since the resin is excellent in terms of mass production, the casing 10 is preferably made of the resin.

(Casing)

As illustrated in FIGS. 1 and 2, the casing 10 includes a base portion 11 that has a bearing housing 11*a* at a center thereof and is disposed with the motor 20 (see FIG. 1), a sidewall portion 12 that is provided along an outer periphery of a blade 32 of the impeller 30 (see FIG. 1), and a connection portion 13 that connects the sidewall portion 12 and the base portion 11.

In this embodiment, the connection portion 13 is provided in the form of spoke, but may be provided in the form of stationary blade.

As illustrated in FIG. 1, two bearings 14 are provided in the bearing housing 11*a* to be spaced apart from each other in a direction along a shaft 25, the shaft 25 of the motor 20 is rotatably supported by the bearings 14, and thus a rotor 20B of the motor 20 is rotatably disposed with respect to the base portion 11.

A stator core 21 of the motor 20 is fixed to an outer peripheral surface of the bearing housing 11*a,* so that a stator 20A of the motor 20 is disposed with respect to the base portion 11.

In this embodiment, the bearing housing 11*a* is attached to the base portion 11. However, the bearing housing 11*a* may be molded integrally with the base portion at the time of molding of the casing 10 in a resin molding manner such as injection molding.

(Motor)

The motor 20 mainly includes the stator 20A and the rotor 20B.

The stator 20A includes the stator core 21 fixed to the outer peripheral surface of the bearing housing 11*a,* an insulator 22 provided on the stator core 21, and a coil 23 provided on the stator core 21 with the insulator 22 interposed therebetween.

On the other hand, the rotor 20B includes the shaft 25 that is rotatably supported by the two bearings 14 provided in the bearing housing 11*a* and serves as a rotating shaft, a rotor yoke 26 that is fixed to the shaft 25 and rotates together with the shaft 25, and a rotor magnet 27 that is fixed to the rotor yoke 26 and rotates together with the shaft 25 and the rotor yoke 26.

The rotor yoke 26 includes a disk portion 26*a* having a press-fit fixing portion 26*aa* to which the shaft 25 is press-fitted at the center, and a cylindrical portion 26*b,* one end of which is connected to an outer peripheral portion of the disk portion 26*a* and which is provided such that the rotor magnet 27 faces the stator core 21 so as to cover the outer periphery of the stator core 21. The cylindrical portion 26b also serves as a portion to which the impeller 30 (to be described below) is attached.

(Impeller)

Figure 3:
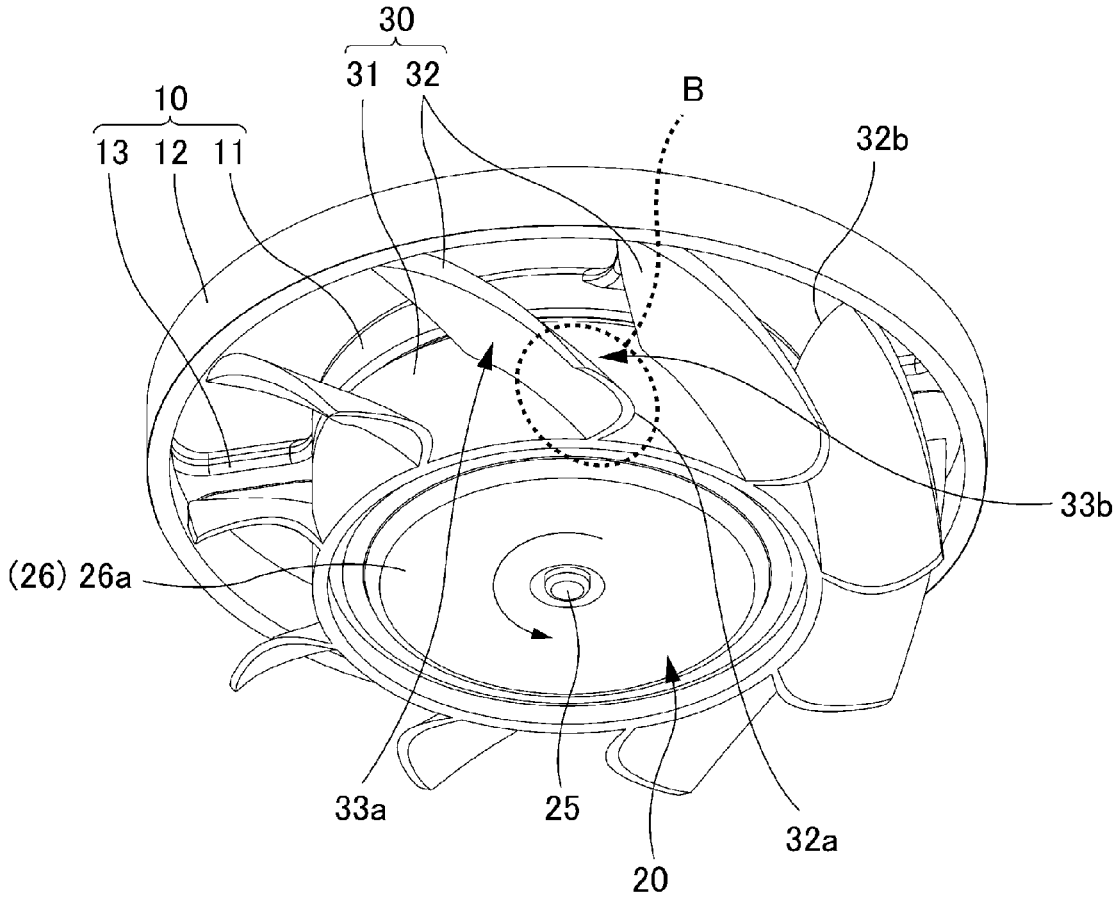
FIG. 3 is a perspective view of the fan according to the embodiment of this disclosure as viewed from an air outlet.
Figure 4:
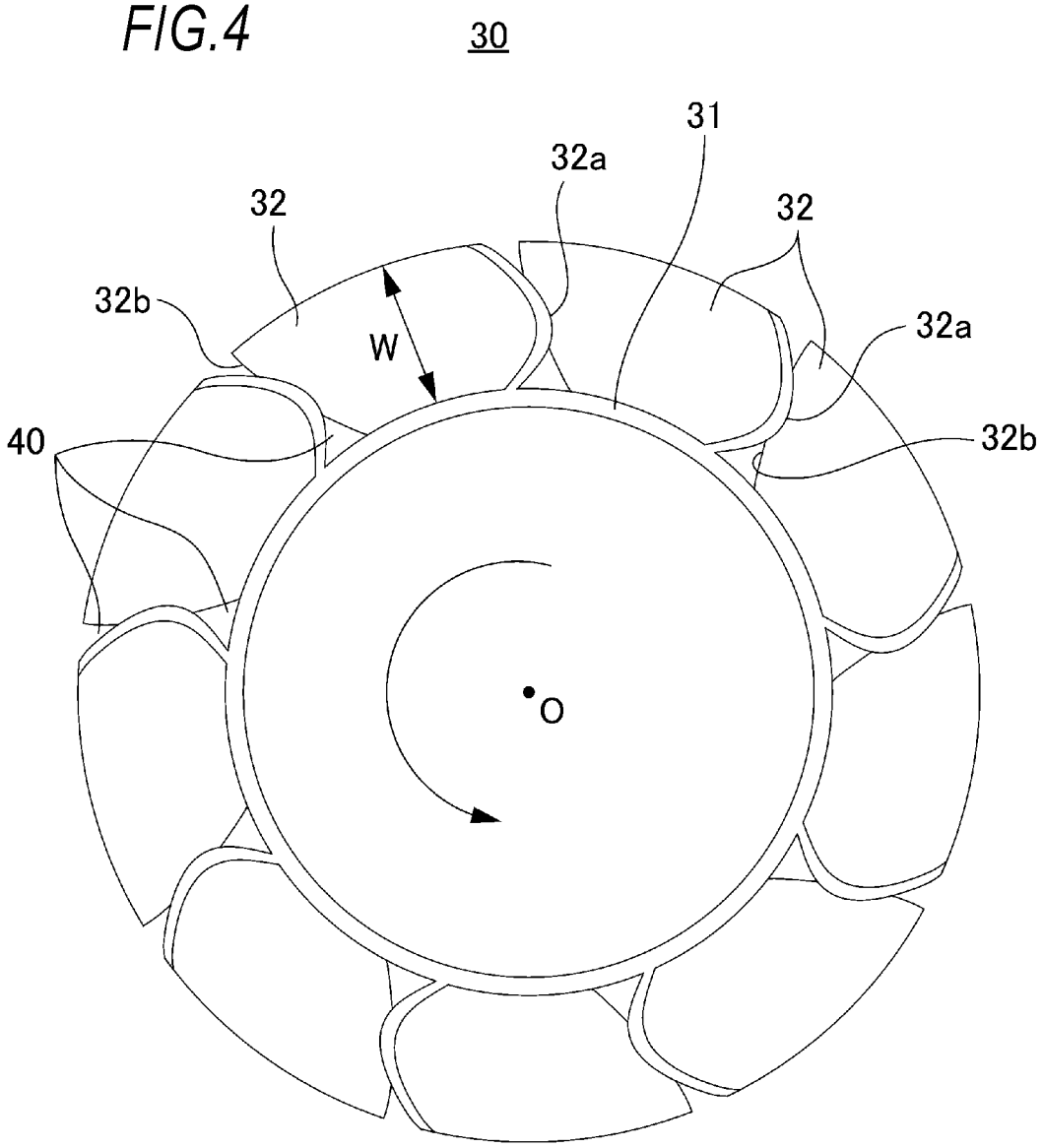
FIG. 4 is a plan view of an impeller according to the embodiment of this disclosure as viewed from the air outlet.

FIG. 3 is a perspective view of the fan 1 as viewed from the air outlet, and FIG. 4 is a plan view of the impeller 30 as viewed from the air outlet in a direction of a rotation axis (axial direction of the shaft 25).

Figure 5:
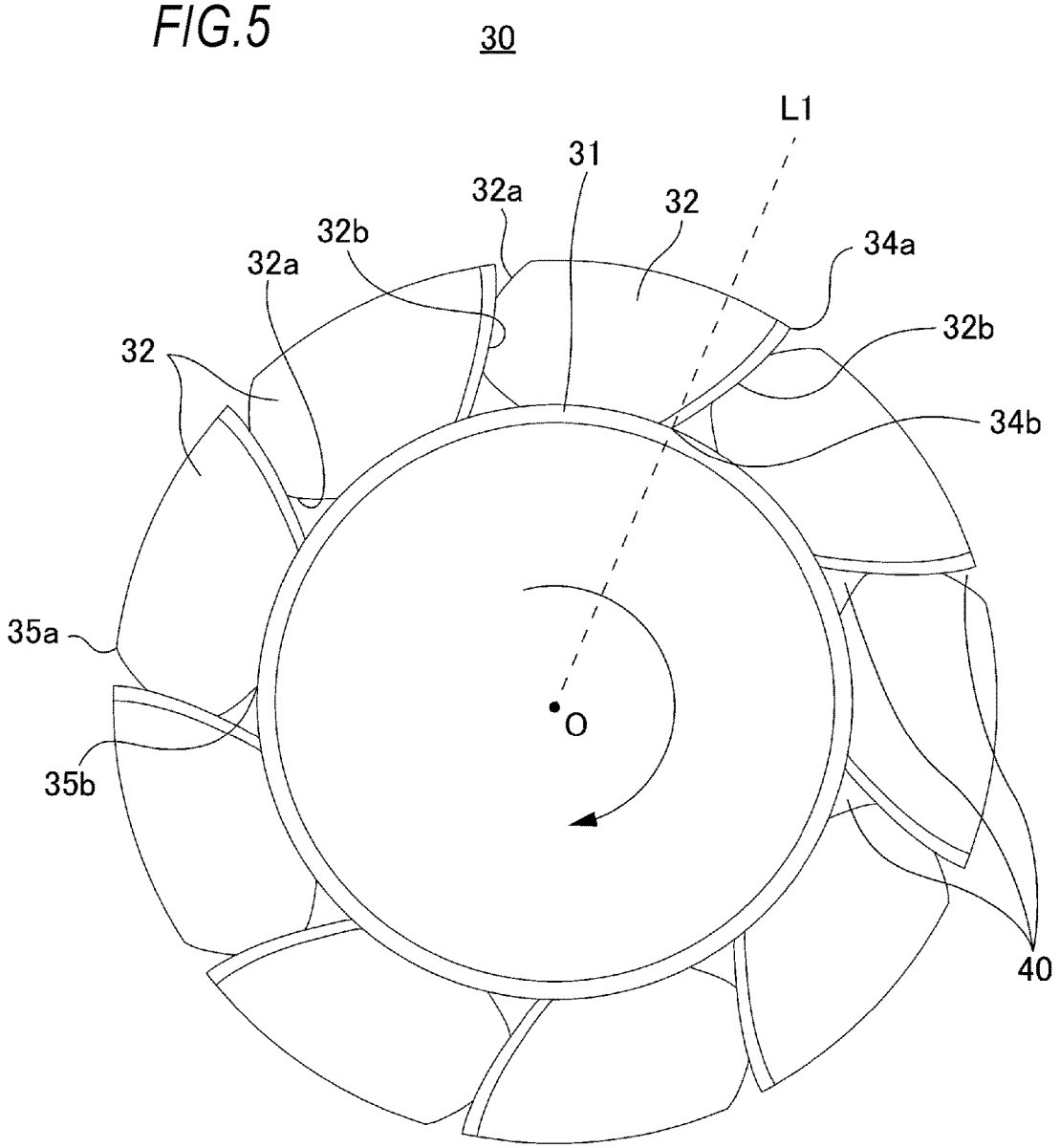
FIG. 5 is a plan view of the impeller according to the embodiment of this disclosure as viewed from the air inlet.
Figure 6:
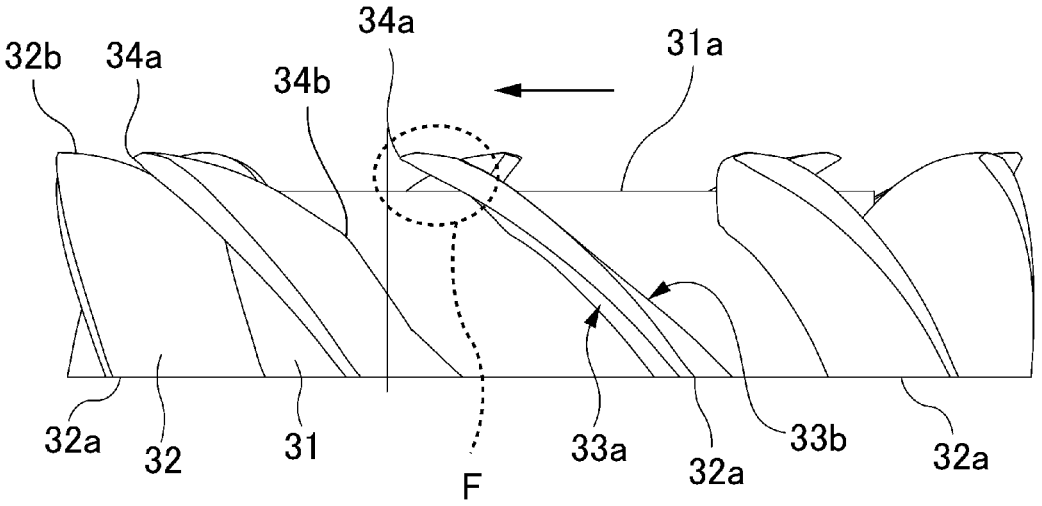
FIG. 6 is a plan view of an outer peripheral surface of a hub of the impeller according to the embodiment of this disclosure as viewed from the front.

Contrary to FIG. 4, FIG. 5 is a plan view of the air inlet of the impeller 30 as viewed in the direction of the rotation axis (axial direction of the shaft 25), and FIG. 6 is a plan view of an outer peripheral surface of a hub 31 of the impeller 30 as viewed from the front.

Arrows illustrated in FIGS. 3 to 5 indicate rotation directions of the impeller 30 to be rotated by the motor 20, respectively. In FIGS. 4 and 5, a symbol O indicates a rotation center at which the center of the shaft 25 is located when the impeller 30 is provided in the fan 1.

As illustrated in FIG. 3, the impeller 30 includes the hub 31 having a ring shape and the plurality of blades 32 provided on the outer periphery of the hub 31. As illustrated in FIGS. 4 and 5, nine blades 32 are provided in this embodiment.

As illustrated in FIG. 1, the impeller 20 is attached to the motor 30 such that the hub 31 is mounted onto the outer periphery of the rotor yoke 26 included in the rotor 20B of the motor 20.

FIG. 4 is the plan view as viewed from the direction of the rotation axis (axial direction of the shaft 25) as described above. As illustrated in FIG. 4, the blade 32 has a trailing edge 32*a* of which an inner side of a radial width W of the blade 32 is curved in a direction opposite to the rotation direction (see the arrow) in a plan view as viewed in the direction of the rotation axis.

More specifically, as can be seen from a portion B surrounded by a dotted line in FIG. 3, the blade 32 has a shape such that a side close to the trailing edge 32*a* of the blade 32 swells toward a suction side 33*h* opposite to a pressure side 33*a* for catching wind when the impeller 30 rotates. As described with reference to FIG. 4, since the trailing edge 32*a* is formed in such a manner that the inner side of the radial width W of the blade 32 is curved in the direction opposite to the rotation direction (see the arrow), the side close to the trailing edge 32*a* of the blade 32 swells.

Since an outer side of the blade 32 has a greater distance from the rotation center O of the impeller 30 in the radial direction of the blade 32, the impeller 30 has a higher circumferential speed at the time of rotation.

For this reason, a workload given by the blade 32 to the air becomes larger toward the outer side in the radial direction of the blade 32. Therefore, when the impeller is configured to receive a lot of air at the outer side in the radial direction of the blade 32, an air volume can he increased, and, at the same time, a torque to be applied to the motor 20 and power consumption also increase.

Thus, the trailing edge 32*a* is formed in such a manner that the inner side of the radial width W of the blade 32 is curved in the direction opposite to the rotation direction (see the arrow), whereby a side close to the trailing edge 32*a* of the blade 32 has the swelling shape. With such a configuration, the air taken in from the leading edge 32*b* of the blade 32 flows along the pressure side 33*a* of the blade 32 and flows to the air outlet, and thus the flow of the air is guided to the inner side of the blade 32, which is small in terms of the load related to the motor 20, rather than the outer side of the blade 32. Further, with such a configuration, the increase in torque is suppressed, and the air is efficiently delivered while suppressing the increase in power consumption.

On the other hand, a straight line connecting the leading edge 32*b* and the trailing edge 32*a* in a cross section obtained when the blade 32 is cut at a portion equidistant from the rotation center O is called a chord, and a length of the chord is called a chord length. As can be understood from the shape of the blade 32 illustrated in FIGS. 4 to 6, the blade 32 is configured such that the outermost side in the radial direction thereof has a longer chord length than a side closest to the rotation center O (a surface part in contact with the hub 31).

As illustrated in FIG. 5, the leading edge 32*b* of the blade 32 is formed to be curved in the rotation direction in a plan view as viewed in the direction of the rotation axis. More specifically, an outer end 34*a* of the leading edge 32*b* is located closer to a side in the rotation direction than a straight line connecting the rotation center O and a hub-side end 34*b* of the leading edge 32*b* (see a dotted line L1), and the leading edge 32*b* is curved in the rotation direction so as to gently connect the outer end 34*a* and the hub-side end 34*b* of the leading end 32*b*.

Further, as illustrated in FIG. 6, the leading edge 32*b* is formed such that the outer end 34*a* of the leading edge 32*b* comes outward out of an end 31*a*, which is the outer peripheral surface of the hub 31, on the leading edge 32*b* in a view as viewed in a direction perpendicular to the rotation axis.

That is, the overall shape of the blade 32 is designed such that the area of the outer side in the radial direction of the blade 32 having a large volume of work becomes large and the air volume is obtained.

Further, as illustrated in FIG. 6, when focused on the outer end 34*a* side (see a circled portion F of a dotted line) of the leading edge 32*b* of the blade 32, the blade 32 is formed such that the outer end 34*a* of the leading edge 32*b* is gently curved (in a figurative sense, for example, slightly bowed down) toward the pressure side 33*a*.

As described above, the outer side of the blade 32 has a large volume of work. However, when a strong air is received at the outer side of the blade 32, the torque related to the motor 20 increases and the power consumption increases.

Specifically, since the leading edge 32*b* of the blade 32 is a portion which starts to take air in, only the flow of air sucked by a suction force accompanying the flow of the air blown from the trailing edge 32*a* is formed, so that the leading edge 32*b* is a position where a collision force of air against the blade 32 is large.

Therefore, the outer end 34*a* of the leading edge 32*b*, which is considered to increase the collision force of air against the blade 32, set to have the shape laid slightly on the pressure side 33*a* as described above, so that a collision angle with the air is gentle, and thus the air smoothly flows (in a figurative sense, for example, slidingly flows) along the surface of the pressure side 33*a* rather than colliding with the pressure side 33*a* on the outer end 34*a* of the leading edge 32*b*.

With such a configuration, it is possible to obtain the area on the outer end 34*a* of the leading edge 32*b* in which the volume of work of the blade 32 is large, and to suppress the increase in the torque related to the motor 20 while increasing the take-in of the air.

By the way, according to this embodiment, as illustrated in FIGS. 4 and 5, the blades 32 adjacent to each other are configured such that a part of the leading edge 32*b* of one blade 32 overlaps with a part of the trailing edge 32*a* of the other blade 32 in the plan view as viewed in the direction of the rotation axis.

In this way, a ratio of a clearance 40, through which the air can linearly exit from the air inlet of the impeller 30 toward the air outlet, becomes smaller, the air blown out when a air outlet static pressure is high becomes difficult to be pushed back to the take-in side of the air, so that air volume-static pressure characteristic can be further improved.

Then, the description will be made with respect to results obtained when the fan 1 according to the embodiment using the impeller 30 having the blade 32 as described above is compared with a fan using an comparative impeller, in terms of the air volume-static pressure characteristic and the power consumption.

(Performance Comparison)

First, the description will be briefly made with respect to a difference in a blade between the fan (the comparative example) using the existing impeller and the fan 1 (embodiment) using the impeller 30 according to the embodiment, and then the description will be made with respect to the air volume-static pressure characteristic and the power consumption.

Figure 7:
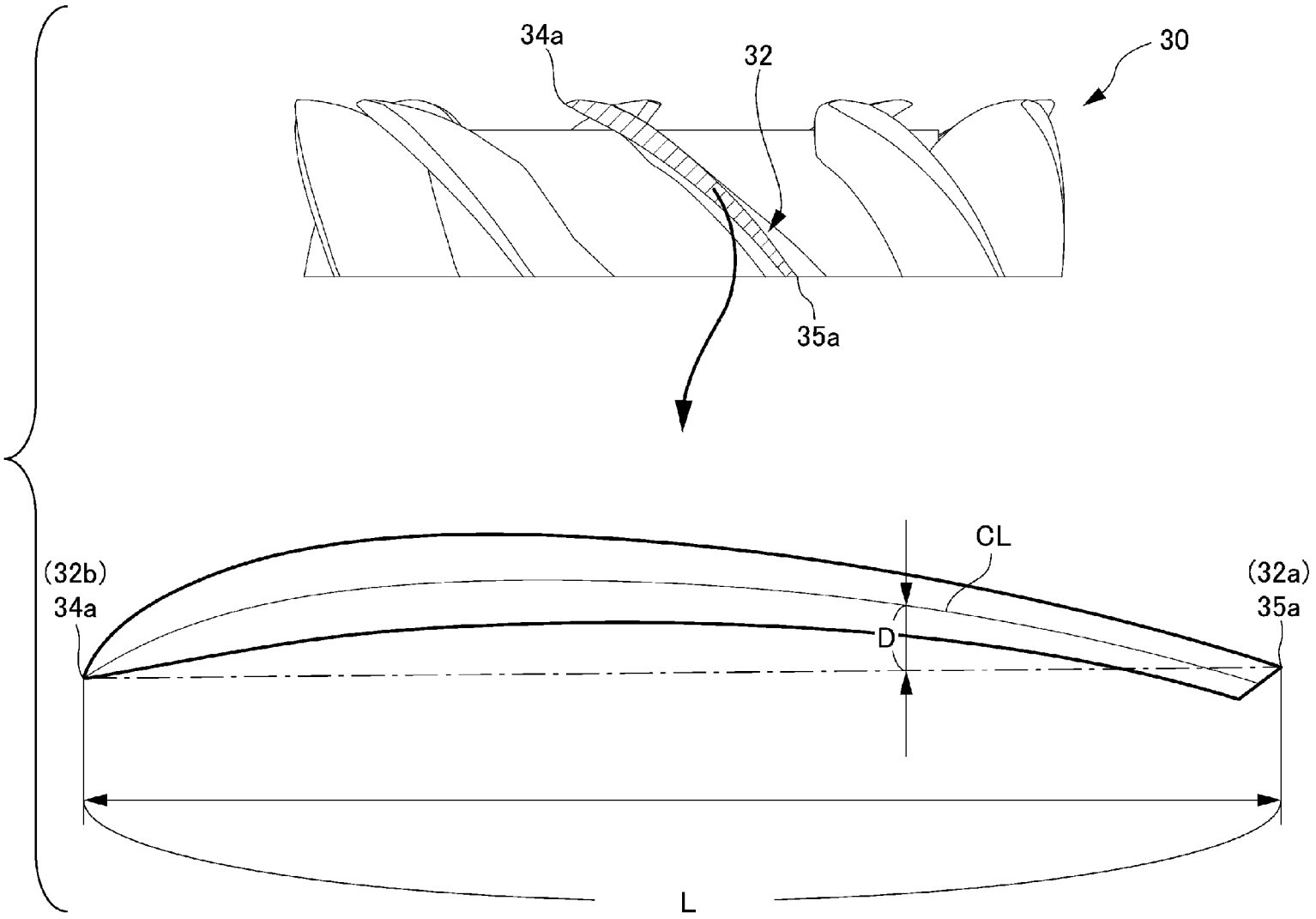
FIG. 7 is a diagram for describing indexes for showing the difference between a blade of an impeller according to the comparative example and the blade of the impeller according to the embodiment of this disclosure.

FIG. 7 is a diagram for describing indexes for showing the difference between the impeller blade according to the comparative example and the impeller blade according to the embodiment of this disclosure.

An upper drawing of FIG. 7 is similar to FIG. 6, and a lower drawing of FIG. 7 illustrates a cross section of the outermost side of the blade 32 in the radial direction (a hatched part in the upper drawing).

As illustrated in the lower drawing of FIG. 7, a straight line (see an alternate long and short dash line) connecting the leading edge 32*b* and the trailing edge 32*a* in the cross section of the blade 32 is generally called a chord, and a length L of the chord is called a chord length (hereinafter, also referred to as a chord length L).

Since the lower drawing of FIG. 7 illustrates the outermost side in the radial direction of the blade 32, the straight line (see the alternate long and short dash line) connecting the outer end 34*a* of the leading edge 32*b* and the outer end 35*a* of the trailing edge 32*a* serves as a chord. For example, in the cross section of the blade 32 which is closest to the hub 31, a straight line connecting the hub-side end 34*b* of the leading edge 32*b* and the hub-side end 35*b* of the trailing edge 32*a* (see FIG. 5) serves as a chord.

Further, as illustrated in the lower drawing of FIG. 7, a line CL passing through the center of the blade 32 is called a camber line (hereinafter, also referred to as a camber line CL).

A percentage of a dimension D between the chord (see the alternate long and short dash line) and the camber line CL with respect to the chord length L is called a camber C (C="D/L"×100 (%)), and the maximum value of values of the camber C obtained depending on the chord is called a maximum camber.

FIGS. 8A and 8B are views illustrating an impeller 130 according to the comparative example, wherein FIG. 8A is a plan view of an outer peripheral surface of a hub 131 as viewed from the front, similarly to FIG. 6, and FIG. 8B is a plan view of an air inlet of the impeller 130 as viewed in the direction of the rotation axis, similarly to FIG. 5.

An arrow illustrated in FIGS. 8A and 8B indicates a direction in which the impeller 130 is rotated by the motor, and a symbol O indicates a rotation center.

In addition, a leading edge of a blade 132 is denoted by reference numeral 132*b*, and a trailing edge thereof is denoted by reference numeral 132*a*.

Figure 9A:
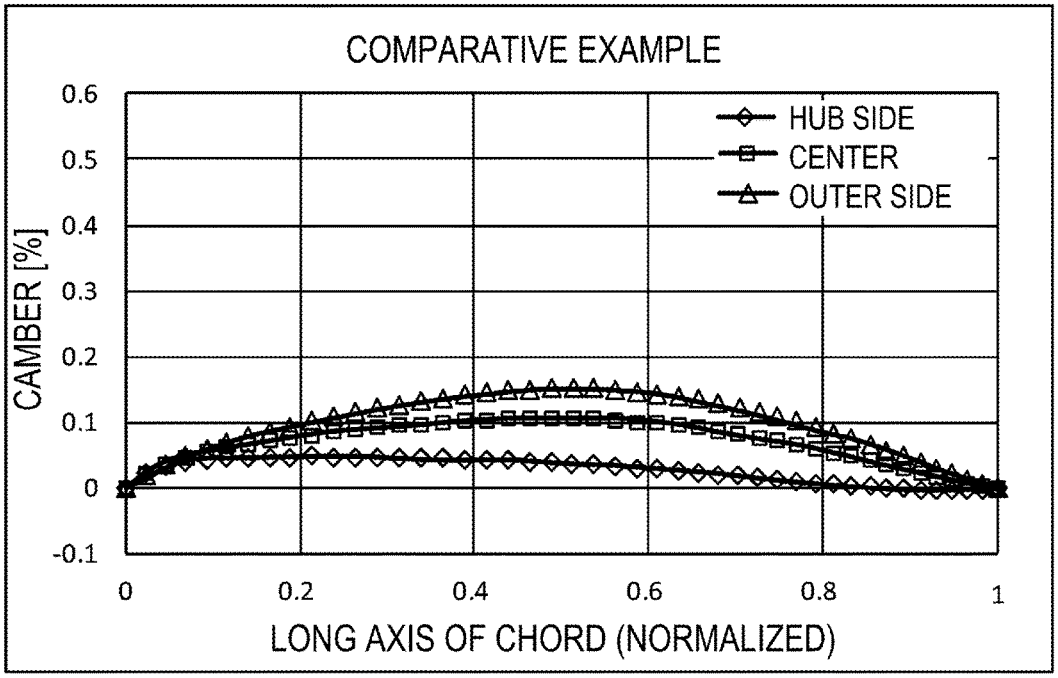
Figure 9B:
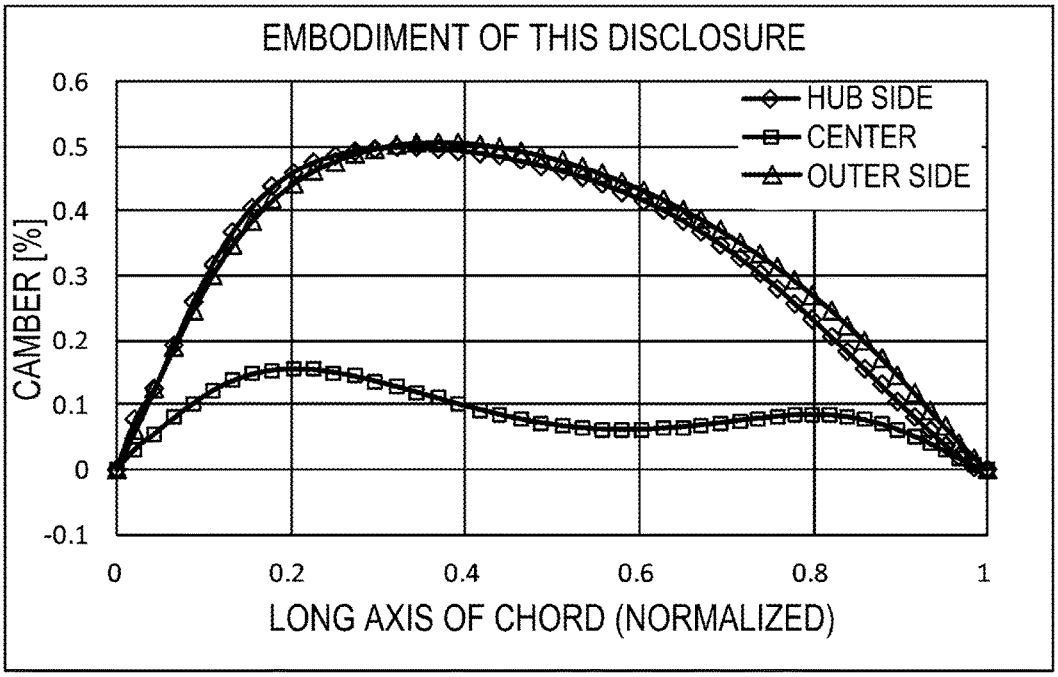

FIGS. 9A and 9B are graphs indicating a camber of the blade 32 according to the embodiment of this disclosure and a camber of the blade 132 according to the comparative example, wherein FIG. 9A is the graph indicating the camber of the blade 132 according to the comparative example, and FIG. 9B is the graph indicating the camber of the blade 32 according to the embodiment of this disclosure.

In FIGS. 9A and 9B, a horizontal axis represents a chord length axis, and a vertical axis represents a camber at each position of the chord.

Meanwhile, the chord length axis is assumed to be normalized such that the chord length becomes 1.

FIGS. 9A and 9B illustrate a camber at three positions in the radial width of the blade. Herein, the camber of the blade at the side closest to the hub is represented by a diamond, the camber of the blade at a center of the radial width is represented by a square, and the camber of the blade at the outermost side is represented by a triangle.

As can be seen by comparison of FIGS. 9A and 9B, the maximum camber of the blade 32 according to the embodiment at the side closer to the hub 31 and the outer side is considerably larger than that of the blade 132 according to the comparative example.

in the camber of the blade 32 according to the embodiment at the center of the radial width W, the maximum camber is slightly larger than the camber of the blade 132 according to the comparative example at the center of the radial width, but is similar to the maximum camber of the blade according to the comparative example at the outer side and is not considerably large the maximum camber. Similarly to the blade according to the comparative example, it is understood that the center of the radial width W of the blade 32 according to the embodiment has a shape approximate to the straight line without being much curved.

As illustrated in FIG. 9B, in the blade 32 according to the embodiment of this disclosure, a maximum camber at the outermost side in the radial direction and a maximum camber at a side closest to the rotation center O are larger than a maximum camber at a center of the radial width W. More specifically, while the maximum camber at the center of the radial width W is less than 0.2% of the chord length, the maximum camber at the outermost side in the radial direction and the side closest to the rotation center O (side closer to the hub 31) is larger than 0.2% of the chord length, which is greater than 0.4%.

As described above, the blade 32 of the embodiment is configured such that the air taken in from the leading edge 32*b* of the blade 32 flows along the pressure side 33*a* (see FIG. 6) of the blade 32 and flows to the air outlet, and thus the flow of the air is guided to the inner side of the blade 32, which is small in terms of the load related to the motor 20, rather than the outer side of the blade 32.

For this reason, the center of the radial width W of the blade 32 is formed such that the maximum camber is small and resistance is hardly generated, whereas the outer side of the blade 32 is designed such that the maximum camber is large and the volume of work increases.

The reason why the camber of the blade 32 at the side closer to the hub 31 is similar to the camber of the blade at the outer side is to guide the air to the inner side of the blade 32 similarly to the outer side so that turbulence of the flow does not occur due to the collision of the air flowing on the pressure side 33*a* with the hub 31.

Further, as can be seen from FIG. 9B, in the blade 32 according to the embodiment, the camber of the blade 32 at the center of the radial width W is slightly increased at the chord length axis from 0.6 to 1.0 corresponding to the side close to the trailing edge 37*a*.

As described above, this means that the side close to the trailing edge 32*a* of the blade 32 has a swelling shape (see the portion B surrounded by the dotted line in FIG. 3) and this portion efficiently guides the air to the air outlet.

Figure 10:
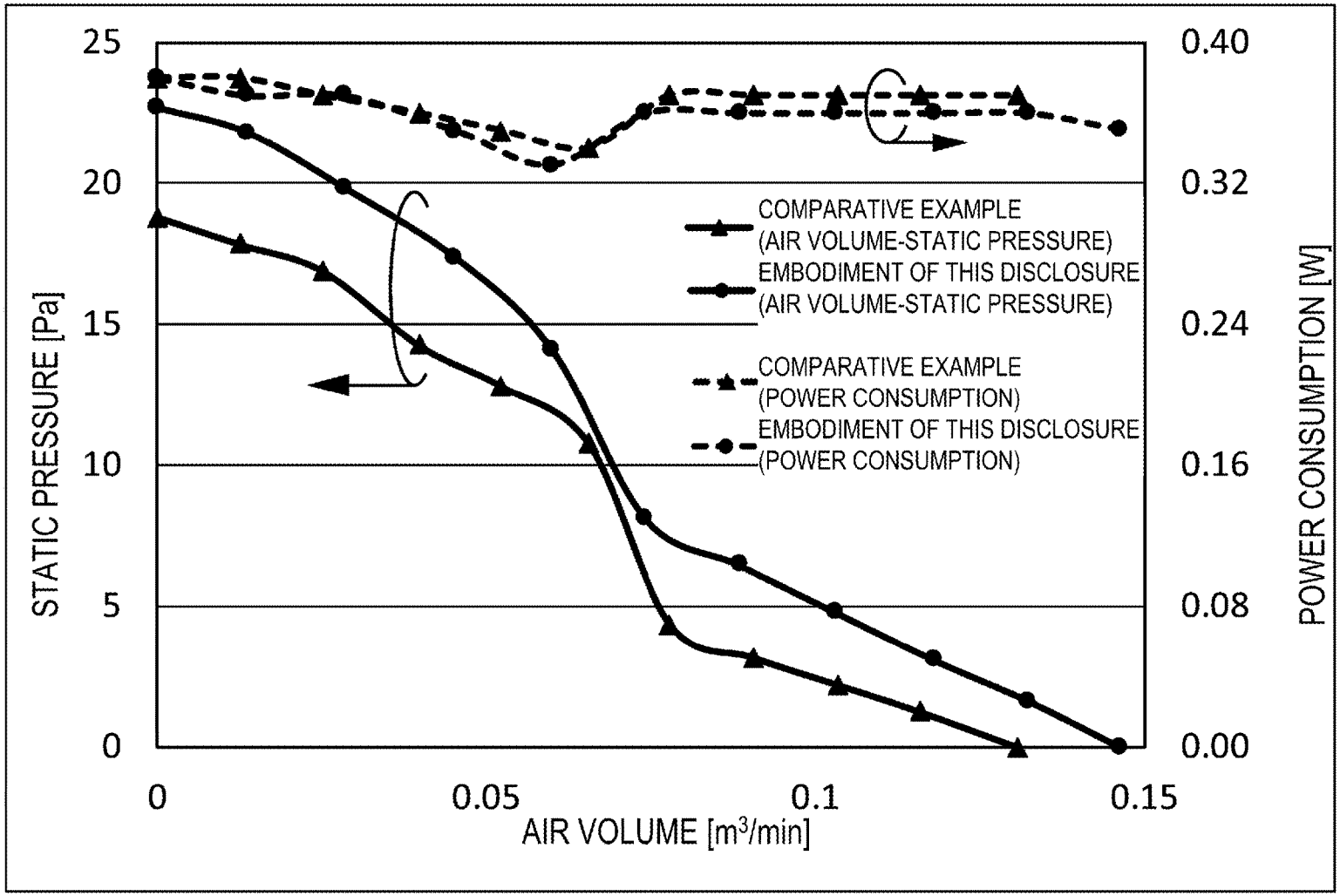
FIG. 10 is a graph obtained by comparison of air volume-static pressure characteristic and power consumption of the fan using the impeller according to the embodiment of this disclosure with those of the fan using the impeller according to the comparative example.

FIG. 10 is a graph (specific example) obtained by comparison of air volume-static pressure characteristic and power consumption of the fan 1 using the impeller 30 according to the embodiment of this disclosure with those of the fan using the impeller 130 according to the comparative example.

In the graph illustrated in FIG. 10, a horizontal axis represents an air volume [$m^3$/min], a left vertical axis represents static pressure [Pa], and a right vertical axis represents power consumption [W].

Circles indicated in the graph of FIG. 10 are results of the fan 1 according to the embodiment, the air volume-static pressure characteristic is indicated by a solid line, and the power consumption is indicated by a dotted line.

Triangles indicate results of the fan according to the comparative example, the air volume-static pressure characteristic is indicated by a solid line, and the power consumption is indicated by a dotted line.

As illustrated in FIG. 10, it is understood that the fan 1 according to the embodiment has a higher static pressure than the fan according to the comparative example even at any air volume, and that the air volume-static pressure characteristic of the fan 1 according to the embodiment is improved.

Further, it is understood that the power consumption of the fan according to the embodiment is substantially similar or slightly improved compared to that of the fan according to the comparative example without exceeding the power consumption of the fan according to the comparative example even at any air volume.

Therefore, according to the fan 1 using the impeller 30 of the embodiment, it is possible to improve the air volume-static pressure characteristic while suppressing an increase in power consumption.

While the embodiment of this disclosure has been described, various changes of this disclosure can be made without departing from the spirit.

In the above description, the case is exemplified where the maximum camber of the outermost side in the radial direction of the blade 32 and the side closest to the rotation center O exceeds 0.4%, which is approximately 0.5%, as illustrated in FIG. 9B, but it is not necessarily limited thereto.

However, the maximum camber of the outermost side in the radial direction of the blade 32 and the side closest to the rotation center O is preferably larger than 0.2%, and more preferably larger than 0.3%.

In the above description, the case is exemplified where the maximum camber of the blade 32 is formed at a position within 40% of the normalized long axis of the chord from the leading edge 32*b* even at any position of the outer side in the radial direction of the blade, the center of the radial width W, and the side closer to the hub 31, but it is not necessarily limited thereto. However, the maximum camber is preferably formed at a position within 50% of the normalized long axis of the chord from the leading edge 32*b*.

In the above description, the case is exemplified where an outer rotor-type motor is used as the motor 20 for rotating the impeller 30, but the motor 20 may be an inner rotor-type motor.

In addition, the sidewall portion 12 of the casing 10 provided along the outer periphery of the blade 32 covers only a part of the leading edge 32*b* of the blade 32 as described above, but the sidewall portion 12 may entirely cover the side surface of the blade 32. Further, the sidewall portion 12 is not limited to the ring shape (cylindrical shape) or the like, and may have a rectangular outer shape formed with a circular hole in which the impeller 30 is disposed.

In the embodiment described above, as illustrated in FIG. 6, the trailing edge 32*a* of the blade 32 is located on a plane substantially flush with the end of the hub 31 on the trailing edge 32*a*, but may be located at the air outlet rather than the end of the hub 31 on the trailing edge 32*a*.

While the specific embodiment of this disclosure has been described, the technical scope of this disclosure is not limited to the above described embodiment. It is apparent to persons skilled in the art that various changes may be made without departing from the spirit of this disclosure and such changes fall within the technical scope of this disclosure.

What is claimed is:

1. An impeller comprising:

a hub having a ring shape; and a plurality of blades that are provided on an outer periphery of the hub, wherein a blade of the plurality of blades has a trailing edge formed such that an inner side of a radial width of the blade is curved in a direction opposite to a rotation direction, in a plan view as viewed in a direction of a rotation axis, wherein in the plan view as viewed in the direction of the rotation axis, the blade has a leading edge that is curved in the rotation direction, and wherein in the plan view as viewed in the direction of the rotation axis, the leading edge is formed such that an outer end of the leading edge is located closer to a side in the rotation direction than a straight line connecting the rotation center and a hub-side end of the leading edge.

2. The impeller according to claim 1, wherein the blade has a shape such that a side close to the trailing edge swells toward a suction side.

3. The impeller according to claim 1, wherein the blade is formed such that a chord length at an outermost side in a radial direction is longer that a chord length at a side closest to a rotation center.

4. The impeller according to claim 1, wherein in a view as viewed in a direction perpendicular to the rotation axis, the leading edge is formed such that the outer end of the leading edge comes outward out of an end, which is the outer peripheral surface of the hub, on the leading edge.

5. The impeller according to claim 1, wherein the blade is formed such that the outer end of the leading edge is curved toward the pressure side.

6. The impeller according to claim 1, wherein in the plan view as viewed in the direction of the rotation axis, two blades adjacent to each other are formed such that a part of the leading edge of one blade overlaps with a part of the trailing edge of the other blade.

7. The impeller according to any one of claims 1, wherein the trailing edge is located on a plane substantially flush with the end of the hub on the trailing edge.

8. A fan comprising:

the impeller according to claim 1; and a motor configured to rotate the impeller.

9. The fan according to claim 8, further comprising:

a casing, wherein the casing includes:

a base portion on which the motor is disposed;

a sidewall portion that is provided along the outer periphery of the blade and covers the outer periphery of the leading edge of the blade; and a connection portion that connects the sidewall portion and the base portion.

10. An impeller comprising:

a hub having a ring shape; and a plurality of blades that are provided on an outer periphery of the hub, wherein a blade of the plurality of blades has a trailing edge formed such that an inner side of a radial width of the blade is curved in a direction opposite to a rotation direction, in a plan view as viewed in a direction of a rotation axis, wherein the blade is formed such that a maximum camber at the outermost side in the radial direction of the blade and a maximum camber at a side closest to the rotation center are larger than a maximum camber at an approximate center of the radial width.

11. The impeller according to claim 10, wherein the maximum camber at the outermost side in the radial direction and the maximum camber at the side closest to the rotation center are larger than 0.2% of a chord length, and the maximum camber at the approximate center of the radial width is less than 0.2% of the chord length.

* * * * *